US005427379A

United States Patent [19]

Lee

[11] Patent Number: 5,427,379

[45] Date of Patent: Jun. 27, 1995

[54] GAMEBOARD

[75] Inventor: De-Lei Lee, Thornhill, Canada

[73] Assignee: Wondergame Corporation, Thornhill, Canada

[21] Appl. No.: 260,916

[22] Filed: Jun. 15, 1994

[51] Int. Cl.[6] ..... A63F 3/00

[52] U.S. Cl. ..... 273/281; 273/264; 273/288

[58] Field of Search ..... 273/153 S, 281, 271, 273/264, 289, 288

[56] References Cited

U.S. PATENT DOCUMENTS

| | | | |
|---|---|---|---|
| 1,085,941 | 2/1914 | Russell | 273/281 |
| 1,518,178 | 12/1924 | Chefko | 273/289 |
| 4,470,601 | 9/1984 | Finn | 273/281 |
| 4,486,017 | 12/1984 | Evert, Jr. | 273/281 |
| 4,620,709 | 11/1986 | Palladino, Jr. | 273/264 |

*Primary Examiner*—Benjamin H. Layno
*Attorney, Agent, or Firm*—Sim & McBurney

[57] ABSTRACT

A gameboard includes a platen having intersecting channels that define a grid of tracks. Playing pieces are movable along the tracks and are retained by a bae on the playing piece that co-operates with the re-entrant walls of the channels. The flanges of the channels extend into the interstices of the tracks to retain the playing pieces while allowing their movement through the interstices.

11 Claims, 3 Drawing Sheets

GAMEBOARD

BACKGROUND OF THE INVENTION

The present invention relates to gameboards.

Many games or puzzles involve the use of boards and pieces that move on the board to determine the outcome of the game or solve the puzzle. Many of these boards are simply planar boards with a pattern or other information printed on one surface. The game pieces are free-standing and are positioned by the player in accordance with the information on the board. This type of board is, of course, very practical for use in a stationary environment but is not suitable for play during travel. Moreover, some games or puzzles require the pieces to be captive to achieve the object of the game. For example, the well-known 15-piece puzzle involves the movement of 15 similar squares within a 4×4 frame to achieve a certain order or pattern.

DESCRIPTION OF THE PRIOR ART

U.S. Pat. No. 4,871,173 to Lammertink discloses a gameboard in which a turntable is provided to allow the order of a row of game pieces to be reversed. The game pieces are arranged in an oval track and can be slid around the track to position certain sequences on the turntable. Although the game pieces are retained on the track, it is only possible to play the one game on the board.

U.S. Pat. No. 4,452,484 to Greene shows a manipulatable game with three orthogonal tracks arranged on a sphere. Tiles slide along the tracks and are supported by convex edges in complementary grooves. At the intersection of the tracks, however, a number of bearings are provided to accommodate movement across the intersection. This arrangement of bearings is both complex and expensive. Moreover, the board is not generally applicable to other games and so play is restricted to one particular game.

U.S. Pat. No. 3,726,527 to Schauffler discloses a travel game in which game pieces in the shape of aircraft or ships move along tracks disposed on the surface of a globe. The tracks are formed as open channels and the pieces retained in the tracks by T-shaped stands. The nature of the game requires pieces to pass one another along the tracks and accordingly the pieces can be removed from the tracks by rotating the piece through 90°. The stand is formed with a length less than the opening in the track so that twisting the piece aligns the base with the opening and allows it to be removed. With this arrangement, the pieces may be inadvertently removed as they cross intersecting tracks as the base is no longer retained in a track. This renders the board generally unsuitable for use as a mobile gameboard and limits its utility.

SUMMARY OF THE INVENTION

It is therefore an object of the present invention to provide a gameboard in which the above disadvantages are obviated or mitigated.

The present invention therefore provides a gameboard having a generally planar platen with a plurality of intersecting channels formed in the platen to define a grid of tracks for movement of playing pieces along and between the tracks. Each of the channels includes a pair of opposed re-entrant walls and a pair of inwardly directed flanges defining a narrowed opening for the channel. Each of the playing pieces includes a head projecting from the channel and a base located within the groove. The head and base are interconnected by a neck passing through the narrowed opening to allow free movement of the pieces along the track and inhibit removal of the pieces from the plane of the board. The flanges extend into the intersection of the tracks to provide overhanging interstices. The base projects beneath the interstices when positioned in the intersection so as to retain the piece captive but permit the piece to move along any of the intersecting tracks.

Preferably the tracks are disposed in an orthogonal grid allowing the pieces to move in the pattern of many popular games. If appropriate, the board may be provided with additional channels to those required to define the playing surface to allow removal of "taken" pieces from the playing area.

It is also preferred that the base of the pieces is biased toward the narrowed opening to facilitate retention of the pieces in the positions that they have been placed. The biasing increases the frictional engagement of the base with the groove and thus inhibits unintentional movement. The biasing allows the pieces to be pushed down out of contact with the underside of the flanges to allow free movement along the slots.

Preferably the biasing is provided by a spring acting between the base and a ball that slides along the base of the groove. A groove is provided to guide the ball and provide a stable position for the ball when at rest. The intersection of the grooves provides a rest position for the playing pieces so that they are located accurately at the intersection.

BRIEF DESCRIPTION OF THE DRAWINGS

An embodiment of the invention will now be described by way of example only with reference to the accompanying drawings, in which.

DETAILED DESCRIPTION OF THE PREFERRED EMBODIMENT

Figure 1:
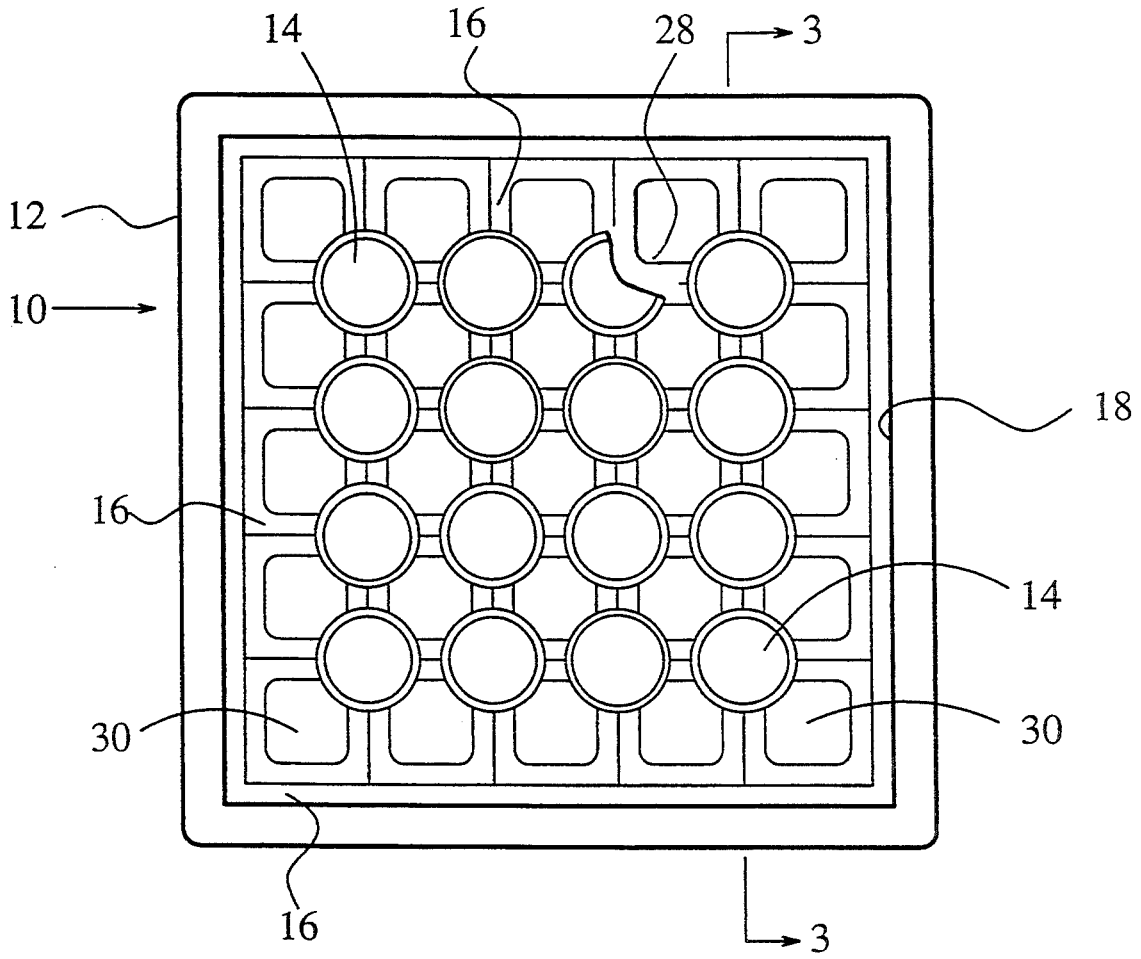
FIG. 1 is a plan view of a gameboard.
Figure 2:
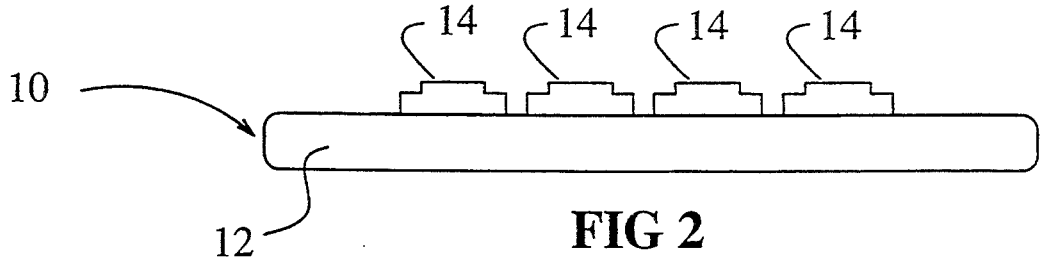
FIG. 2 is a front elevation of the gameboard of FIG. 1.

Referring therefore to the drawings, a gameboard 10 includes a platen 12 and playing pieces 14. The platen 12 is formed with a plurality of intersecting channels 16 that together define a grid of tracks. In the embodiment shown, the grid is formed as a 6 by 6 grid of orthogonal tracks which is delimited by a frame 18.

Figure 3:
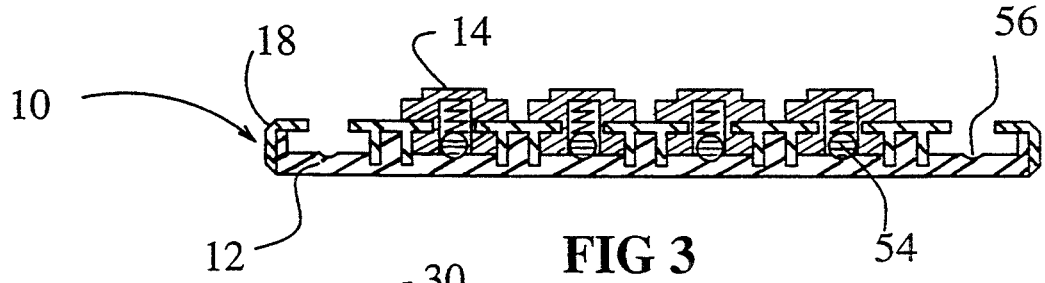
FIG. 3 is a view on the line 3—3 of FIG. 1.
Figure 4:
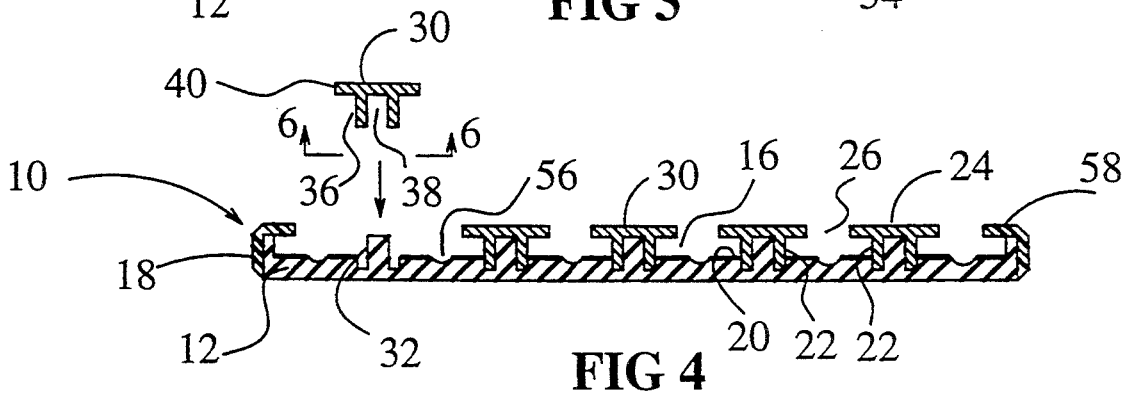
FIG. 4 is a view similar to FIG. 3 showing the assembly of the gameboard of FIG. 1.
Figure 6:
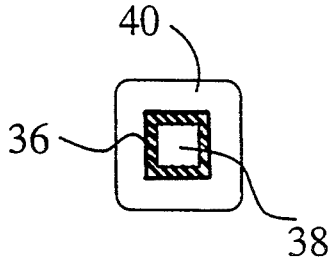
FIG. 6 is a view on the line 6—6 of the component shown in FIG. 4.
Figure 5:
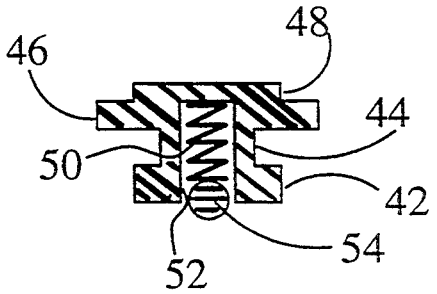
FIG. 5 is a view on an enlarged scale of a portion of the gameboard shown in FIG. 4.
Figure 7A:
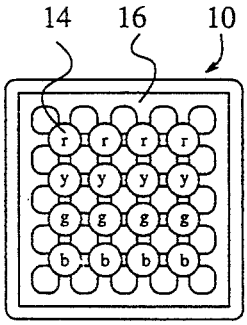
FIG. 7 is a schematic illustration of a game played on the board of FIG. 1 with FIGS. *7a*, *7b*, *7c* and *7d* showing the sequential moves of the playing pieces and FIGS. *7a* and *7d* showing the starting configuration and finished configuration respectively.
Figure 7B:
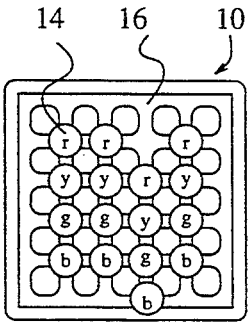
Figure 7C:
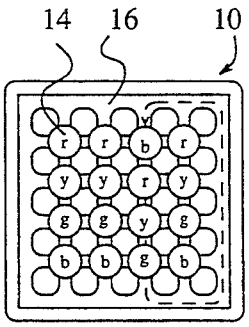
Figure 7D:
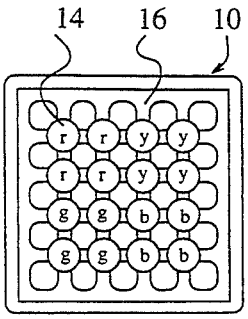
Figure 8A:
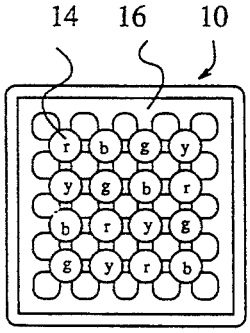
FIG. 8 is an illustration of distinctive configurations of game pieces that can be used in the game shown in FIG. 7.
Figure 8B:
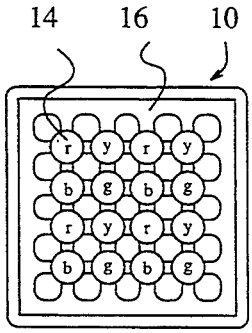
Figure 8C:
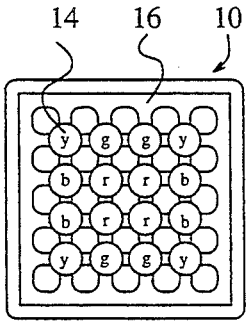
Figure 8D:
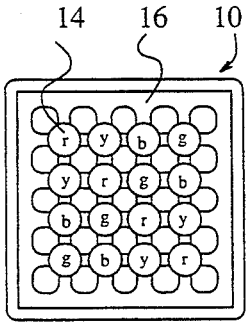

As can best be seen in FIGS. 1,3 and 4, each of the channels 16 is formed with a bottom 20 and a pair of opposed side walls 22. Each of the side walls 22 terminates in an inwardly projecting flange 24 which together define a narrowed opening 26 for the groove 16. The flanges 24 project into the intersection of two grooves to define overhanging interstices indicated at 28.

The tracks formed by the channels 16 are conveniently defined by lands 30 that are supported on posts 32 molded with the platen 12. The posts 30 are uniformly distributed about the base 12 and project upwardly to receive the lands 30. A recess 34 circumscribes each of the posts 32 to receive the lower end of the lands 30.

Each of the lands 30 has a tubular sleeve 36 of rectangular cross-section to define respective portions of the sidewalls 22. A bore 38 is provided to receive the post 32. An enlarged end wall 40 is integrally formed with the sleeve 36 and projects radially beyond the sleeve to define respective portions of the flanges 24. The end wall 40 is square in plan when the tracks are orthogonal as illustrated.

Each of the playing pieces 14 is similar, except for such distinguishing markings as may be required to play the intended game or puzzle, and includes a base 42 connected by a neck 44 to a head 46. The head 46 is circular with a raised central button 48 and is dimensioned to overlie the flanges 24 provided by adjacent end walls 40. The base 42 is dimensioned to be received in the channel 16 between the side walls 22 and is circular in cross-section with the neck 44 similarly dimensioned to pass through the narrowed opening 26. The playing piece is thus free to slide along the channel 16 but movement out of the plane of the platen 12 is prevented by co-operation of the base 42 with the flanges 24.

The circular base 42 also ensures that when the playing pieces 14 are positioned at the intersection of two grooves 16, the base 42 extends beneath the interstices 28 and thus retains the pieces 14.

To facilitate free movement along the channels 16 and at the same time ensure that the pieces 14 remain where placed, the pieces 14 are biased against the flanges 24 by a spring 50. Spring 50 is located in a central bore 52 in the base 42 and acts against a ball 54. The ball 54 rolls along a semi-circular groove 56 formed in the bottom 20 of channel 16 and serves to locate the piece 14 centrally. At the intersection of a pair of channels 16, the grooves also intersect and co-operate with the ball 54 to locate the piece 14 centrally in the intersection. When at rest, the spring 50 biases the body against the flange 24 and provides a frictional resistance for the piece 14 but when it is intended to move the piece 14, pressure may be applied against the button 48 to disengage the flange 24 and base 42.

The gameboard 10 may be used to play a number of popular games that utilize movement of pieces along a grid. In this regard, the buttons 48 may be colored or bear other information that identifies the individual playing pieces.

Assembly of the gameboard 10 simply requires the lands 30 to be placed on the post 32. The recess 34 co-operates with the rectangular cross-section of the sleeve 36 to orientate the lands in the desired location. One of the lands is not placed until the playing pieces 14 have been assembled. This is done by feeding the pieces 14 into the channels 16 in the area permitted by the removed land 30. The pieces 14 are then slid along the channels 16 to make room for additional pieces 14 as required. Once the land 30 is placed on the post 32, the pieces are captive. The frame 18 may be assembled prior to insertion of the pieces and includes an inwardly directed flange 58 to define the peripheral channel 16.

Although a number of different games may be played with the gameboard 10, the versatility of the game may be illustrated by considering the use of the gameboard in solving a particular puzzle.

As seen in FIG. *7a*, each of the playing pieces 14 carries a button of a particular color. Thus the buttons carry red, blue, yellow and green. In an initial configuration, the colors can be distributed randomly. The object is to arrange the colors in a target configuration, for example, all of the pieces 14 bearing the same color aligned in a particular row, in the minimum number of turns. Constraints are placed upon the movement of the pieces so that only a circular shift is permitted. A circular shift is illustrated in FIGS. *7b* and *7c* and is achieved by pushing the four pieces 14 on a row or column one position along in any one of four directions. The lead token is then taken along the peripheral tracks to the vacated position at the opposite end of the row or column.

Assuming that the initial configuration is shown in FIG. *7a* and the target configuration is shown in FIG. *7d*, eight circular shifts will convert the initial configuration to the target. Initially, column three is shifted downwardly followed by a downward shift of column four. Row two is then shifted to the left twice followed by two right shifts of row four. Column three and column four are then sequentially shifted upwardly to arrive at the target configuration.

By restricting the sequence of movements to, for example, a circular shift, logical thinking and strategic planning skills are developed.

As shown in FIG. 8, a number of configurations have distinct features although a total of 63,063,000 different configurations of playing pieces are available from the 4 by 4 matrix of pieces. In FIG. *8a*, each row, column and diagonal contains only one playing piece of each color. FIG. *8b*, on the other hand, contains two colors in each row or column with the colors of the playing pieces alternating along the row, column and diagonals. FIG. *8c* groups the four colors of playing pieces into each quarter of the grid.

In the arrangement shown in FIG. *8d*, the diagonals define axes of symmetry for the different colored playing pieces.

In the embodiment described, the board is shown as a rectangular grid having a free peripheral track. Other configurations of tracks may be utilized such as tracks that intersect at other than right angles or circular boards with additional tracks outside the square playing matrix. This arrangement provides storage capabilities for surplus playing pieces, allowing more than one game to be played on the board.

As a further alternative, the tracks could be defined by concentric circular channels with radial channels extending between adjacent circles.

The base 42 may also be configured to prevent the rotational movement of the playing pieces on the track. In such an arrangement, the base 42 would be square in cross-section and therefore be constrained against rotation while moving along a track.

As an alternative to the lands and posts shown in FIGS. 1–6, it is possible to mold the lands integrally with the platen. The frame 18 is a separate piece and may be removed to allow insertion of the playing pieces.

If it is desirable to mold the frame with the platen, then an opening may be provided for loading of the playing pieces. An insert is then secured to the frame to close the opening.

Although the lands have been shown as square to define a rectangular grid, alternative shapes of land may be used. Similarly, the playing pieces can be shaped to suit the particular game to be played and may carry additional indica or representations on the head.

It will be seen therefore that a very simple but versatile gameboard is provided which retains the playing pieces during transport and during play. At the same time, the gameboard is relatively simple to manufacture.

I claim:

1. A gameboard having a generally planar platen with a plurality of intersecting channels formed in the platen to define a grid of tracks for movement of playing pieces along and between said tracks, each of said channels including a pair of opposed re-entrant walls and a pair of inwardly directed flanges defining a narrowed opening for said channel, each of said playing pieces including a head projecting from the channel and a base located within the channel, said head and base being interconnected by a neck passing through the narrowed opening to allow free movement of the pieces along said tracks and inhibit removal of said pieces from the plane of said gameboard, said flanges extending into intersections of said tracks to provide overhanging interstices and said bases projecting beneath said interstices when positioned in an intersection so as to retain said playing pieces captive whilst permitting movement thereof along any of said intersecting tracks, a biasing means being provided to bias said playing pieces into engagement with said flanges.

2. A gameboard according to claim 1 wherein said tracks are disposed in an orthogonal grid.

3. A gameboard according to claim 1 wherein said biasing means biases said base into engagement with said flanges.

4. A gameboard according to claim 3 wherein said base is supported on a rolling member for movement along a track.

5. A gameboard according to claim 4 wherein said rolling member is guided in a groove on a bottom surface of said channel.

6. A gameboard according to claim 5 wherein said rolling member is a ball and said biasing means acts between said ball and said base.

7. A gameboard according to claim 1 wherein said tracks are defined by adjacent lands secured to said platen in a uniformly spaced array.

8. A gameboard according to claim 7 wherein said lands have an end wall projecting beyond a body of said land to define said flanges.

9. A gameboard according to claim 8 wherein said body is inhibited from rotation on said platen.

10. A gameboard according to claim 9 wherein a lower end of said body is received in a complementary recess in said platen.

11. A gameboard according to claim 7 wherein a frame extends about the periphery of said platen and includes an inwardly directed edge to define a flange of a peripheral track.

* * * * *